US009859617B1

(12) United States Patent
Desclos et al.

(10) Patent No.: US 9,859,617 B1
(45) Date of Patent: Jan. 2, 2018

(54) ACTIVE ANTENNA STRUCTURE MAXIMIZING APERTURE AND ANCHORING RF BEHAVIOR

(75) Inventors: Laurent Desclos, San Diego, CA (US); Sung-Soo Nam, Seoul (KR); Ji-Chul Lee, Gyeomggi-do (KR); Sung Hawan, Gyeomggi-do (KR); Chun-Su Yoon, Gyeomggi-do (KR)

(73) Assignee: ETHERTRONICS, INC., San Diego, CA (US)

( * ) Notice: Subject to any disclaimer, the term of this patent is extended or adjusted under 35 U.S.C. 154(b) by 1045 days.

(21) Appl. No.: 13/609,138

(22) Filed: Sep. 10, 2012

Related U.S. Application Data

(60) Provisional application No. 61/532,822, filed on Sep. 9, 2011.

(51) Int. Cl.

| | |
|---|---|
| ***H01Q 7/00*** | (2006.01) |
| ***H01Q 9/04*** | (2006.01) |
| ***H01Q 9/28*** | (2006.01) |
| ***H01Q 9/42*** | (2006.01) |
| ***H01Q 5/48*** | (2015.01) |
| ***H01Q 5/321*** | (2015.01) |

(52) U.S. Cl.
CPC ..... *H01Q 9/285* (2013.01); *H01Q 5/321* (2015.01); *H01Q 5/48* (2015.01); *H01Q 7/00* (2013.01); *H01Q 9/0414* (2013.01); *H01Q 9/42* (2013.01)

(58) Field of Classification Search
CPC ..... H01Q 9/0414; H01Q 9/42; H01Q 5/321; H01Q 5/48; H01Q 7/00
See application file for complete search history.

(56) References Cited

U.S. PATENT DOCUMENTS

| | | | | |
|---|---|---|---|---|
| 2006/0220966 | A1* | 10/2006 | Sarychev et al. | 343/702 |
| 2007/0229376 | A1* | 10/2007 | Desclos et al. | 343/718 |
| 2008/0316121 | A1* | 12/2008 | Hobson | H01Q 9/42 343/702 |
| 2009/0051611 | A1* | 2/2009 | Shamblin et al. | 343/747 |

* cited by examiner

*Primary Examiner* — Dieu H Duong
*Assistant Examiner* — Michael Bouizza
(74) *Attorney, Agent, or Firm* — Coastal Patent Law Group, P.C.

(57) ABSTRACT

An antenna methodology where a set of antennas are formed that take the shape of a mobile wireless device and can be integrated into the outer housing of the mobile device. Tuning points are integrated into the design to provide the capability to compensate for hand effects and loading while the mobile device and antenna are touched by the user. The body then becomes a part of the antenna and acts as an anchor for the poles within the matching circuit. These antennas are actively tuned based on detection criteria while dynamically tracking system performance. The structure is based on a loaded loop coupled to an isolated magnetic dipole (IMD) element. The loop is actively tuned according to design rules residing in a processor in the mobile device.

19 Claims, 16 Drawing Sheets

ACTIVE ANTENNA STRUCTURE MAXIMIZING APERTURE AND ANCHORING RF BEHAVIOR

CROSS-REFERENCE TO RELATED APPLICATIONS

This application claims benefit of priority with U.S. Provisional Application Ser. No. 61/532,822, filed Sep. 8, 2011; the contents of which are hereby incorporated by reference.

BACKGROUND OF THE INVENTION

Field of the Invention

This invention relates to antenna systems integrated into wireless mobile devices; and in particular to antennas adapted to couple to a user of the device to compensate and optimize the antenna system during use when hand and body loading are occurring.

Related Art

There is a current need for improved connectivity at cellular and data transmission bands for mobile devices to accommodate the increasing demand for data rates for mobile wireless systems. Improved antenna performance, such as increased efficiency, will translate into increased data rates. A method for increasing antenna system performance in wireless devices is to increase antenna volume; unfortunately, the trend in mobile devices is to decrease overall product size along with increasing the number of functions required to be integrated into the platform.

In further complication of the antenna design process, antenna performance needs to be optimized and characterized for several use cases, such as: device against the user's head, device in hand, and device against the body.

Isolated Magnetic Dipole (IMD) antennas are generally formed by coupling one element to another in a manner that forms a capacitively loaded inductive loop, setting up a magnetic dipole mode. This magnetic dipole mode provides a single resonance and forms an antenna that is efficient and well isolated from the surrounding structure. This is, in effect, a self-resonant structure that is de-coupled from the local environment.

The overall structure can be considered as a capacitively loaded inductive loop. The capacitance is formed by the coupling between the two parallel conductors with the inductive loop formed by connecting the second element to ground. The length of the overlap region between the two conductors along with the separation between conductors is used to adjust the resonant frequency of the antenna. A wider bandwidth can be obtained by increasing the separation between the conductors, with an increase in overlap region used to compensate for the frequency shift that results from the increased separation.

An advantage of the IMD antenna structure is the method in which the antenna is fed or excited. The impedance matching section is almost independent from the resonant portion of the antenna. This leaves great flexibility for reduced space integration. At resonance, a cylindrical current going back and forth around the loop is formed. This generates a magnetic field along the axis of the loop which is the primary mechanism of radiation. The electrical field remains highly confined between the two elements. This reduces the interaction with surrounding metallic objects and is essential in obtaining high isolation.

Though de-coupled from the surrounding environment, the IMD antenna will still exhibit de-tuning in terms of frequency shift and/or impedance variations when subjected to external loading, such as body loading by the user during operation of the mobile communication device.

SUMMARY OF THE INVENTION

To compensate for frequency and/or impedance shifts due to environmental changes, active tuning components can be coupled to the antenna element or integrated into the matching circuit at the feed port of the antenna to adjust the resonant frequency and/or impedance properties of the antenna.

In various embodiments, one or more antennas are embedded into an external structure of a mobile device to minimize volume requirements.

The one or more of the antennas may comprise an Isolated Magnetic Dipole (IMD) element used to set up one or more fixed resonances.

An internal radiator, one within the device, may be coupled to external radiator, one embedded into the external structure, to form additional resonance which can be tuned to shift into the frequency band of interest when the device is loaded by an external object (user's hand, head, body)

In certain embodiments, one or more tuning elements are integrated along an antenna element and used to compensate for body loading.

In another aspect of the invention, an algorithm residing in a processor senses antenna de-tuning due to body loading and sends control signals to the active tuning components to re-tune the antenna for improving a current loading environment.

DETAILED DESCRIPTION OF THE PREFERRED EMBODIMENTS

Figure 1:
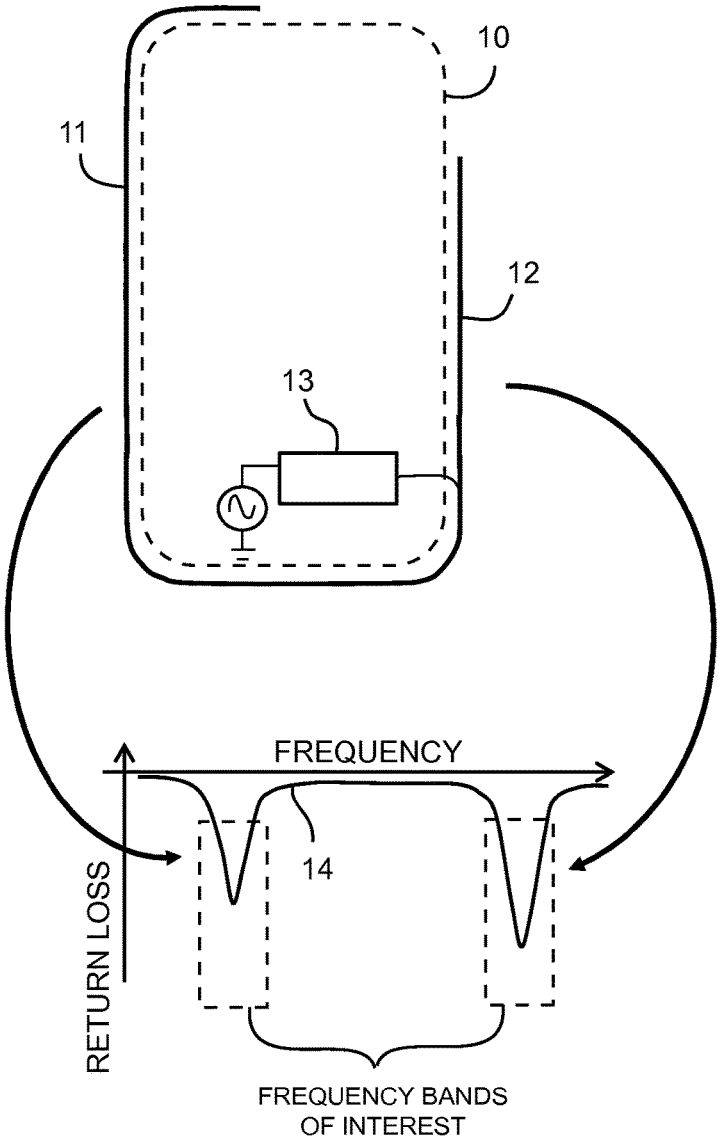
FIG.1 (PRIOR ART)
FIG. 1 illustrates a mobile device with an antenna positioned external to the device.

FIG. 1 illustrates a conventional antenna topology used in wireless mobile devices, with the mobile device having an external periphery 10 with an antenna positioned external to the device. The antenna includes a first conductor coupled to a feed, and having a first portion 11 forming a low frequency band radiator, and a second portion 12 forming a high frequency band radiator, the first and second portions are separated at the antenna feed. The antenna can be integrated into an external feature, such as a housing or bezel. A matching circuit 13 is positioned internal to the mobile device and is coupled to the external antenna formed by the first and second portions of the first conductor. The matching circuit is used to impedance match the external antenna. Low frequency and high frequency resonances are shown in the plot of return loss as a function of frequency. The plot shows the corresponding resonances of the first and second conductor portions as well as the frequency bands of interest for which the antenna is designed to operate. The antenna provides a low frequency resonance and a high frequency resonance making up the fundamental resonance pattern 14 of the antenna in free space.

Figure 2:
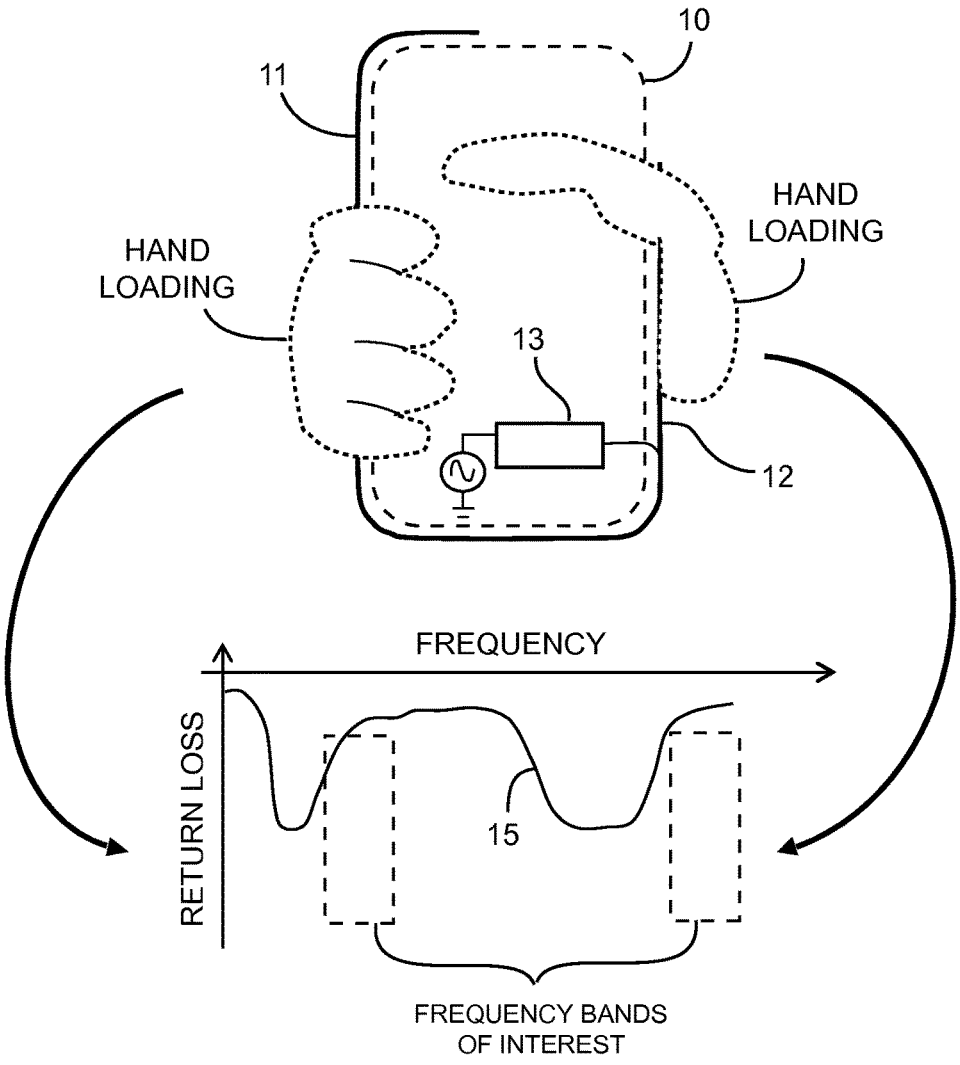
FIG.2 (PRIOR ART)
FIG. 2 illustrates a mobile device with an antenna positioned external to the device, where a user's hand is loading the antenna.

FIG. 2 illustrates a conventional mobile device with an antenna positioned external to the device, wherein a user's hand is shown loading the antenna. As a result of hand-loading of the device, the frequency response of the antenna will shift lower in frequency. The device is similar to that of FIG. 1, and includes an antenna having a first conductor with first portion 11 and a second portion 12 each positioned external to the device periphery 10, generally in a bezel or housing portion of the device. A matching circuit 13 is positioned internal to the mobile device and is coupled to the external antenna. The matching circuit is used to impedance match the external antenna. The result of the hand-loading is a shift in the resonant frequency of the antenna, more commonly known as "antenna detuning". Note that the resonances are detuned outside of the frequency bands of interest as is illustrated in the associated plot in FIG. 2.

Figure 3:
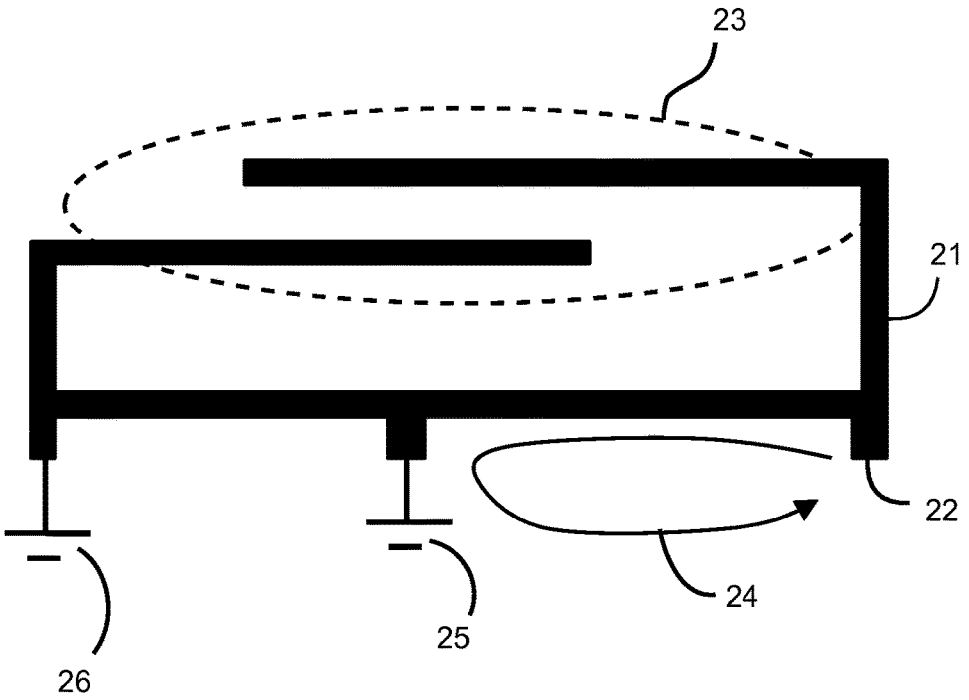
FIG.3 (PRIOR ART)
FIG. 3 illustrates an "M" type Isolated Magnetic Dipole (IMD) antenna.

FIG. 3 illustrates an "M" type Isolated Magnetic Dipole (IMD) antenna 21. A capacitive coupled section 23 is formed by overlapping sections of conductor and results in a radiating portion of the antenna. The antenna further includes a loop 24 formed by the feed terminal 22 and a ground connection 25. The ground connection 25 is a variable ground connection configured for tuning the ground connection. The loop 24 is adjusted to alter the impedance of the IMD antenna. The antenna further includes a static ground connection 26.

Figure 4:
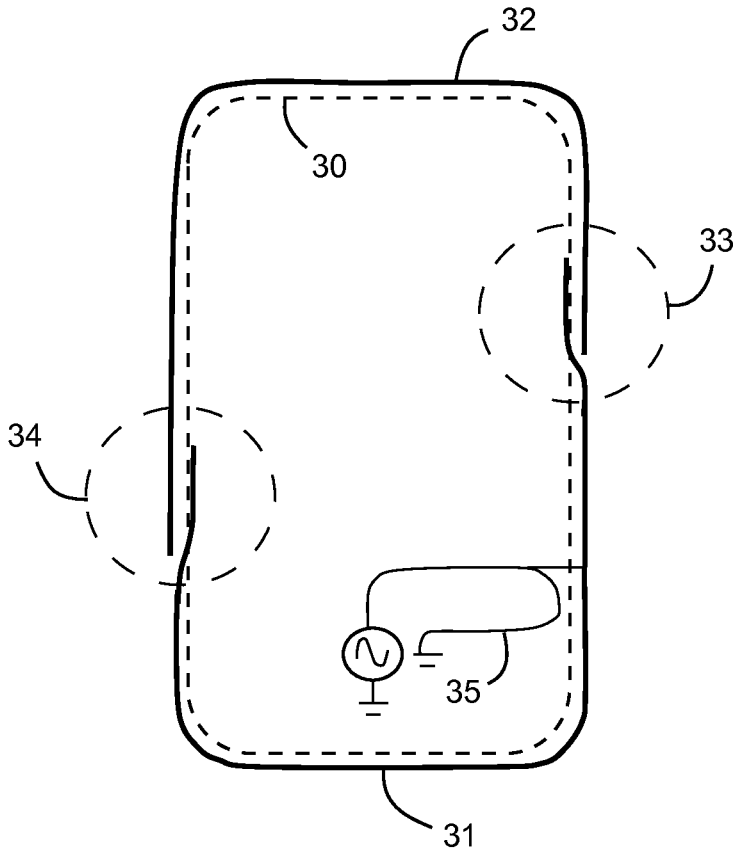
FIG. 4 illustrates an improved external antenna for integration with a mobile device.

FIG. 4 illustrates an improved topology for integrating an antenna external to a mobile device. In the periphery of the mobile device 30, an IMD antenna is formed with the overlap of the first conductor 31 and the second conductor 32, the overlapping sections form two coupled regions, the first coupled region 34 is used to form a low frequency resonance and the second coupled region 33 is used to form a high frequency resonance. A loop 35 is integrated internal to the mobile device, with the loop coupled to the IMD antenna 31-34. The loop is used to feed the IMD antenna and can be adjusted to impedance match the IMD antenna to the transceiver. The internal loop is dimensioned such that the loop radiates or receives RF signals. The resonant frequency of the loop is adjusted such that the resonance is offset from the resonance of the external IMD antenna.

Figure 5A:
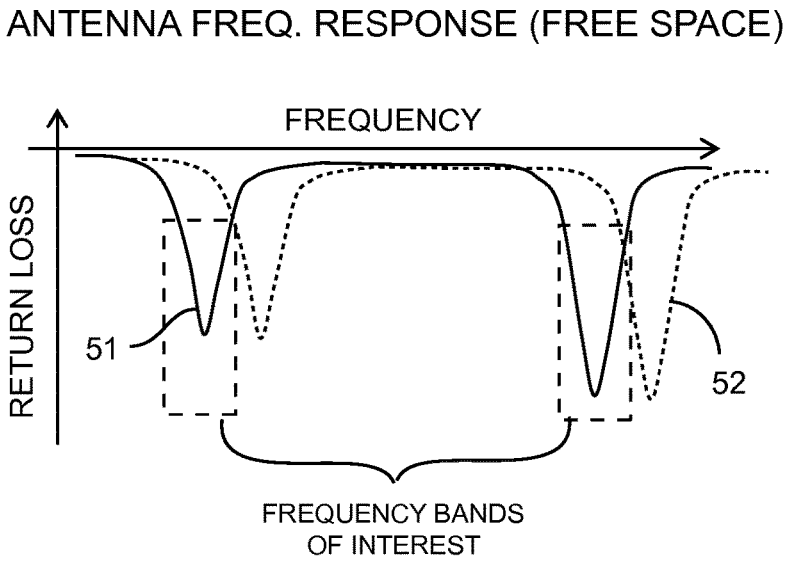
FIG. 5A illustrates the return loss behavior of the antenna described of FIG. 4 in free space.
Figure 5B:
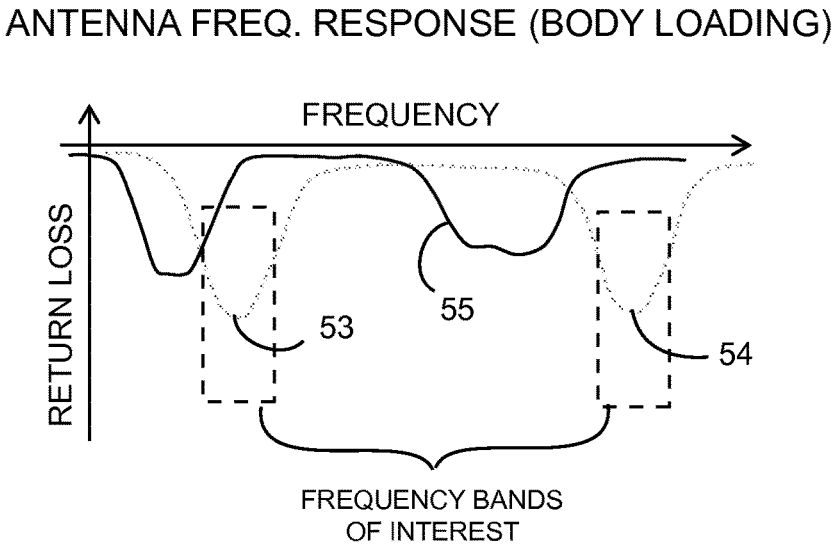
FIG. 5B illustrates the return loss behavior of the antenna described of FIG. 4 as detuned from body loading.

FIGS. 5(A-B) illustrate the return loss behavior of the antenna described in FIG. 4. With the antenna in free space (51), the low band and high band resonances from the radiator are well centered in the frequency bands of interest. The resonances as adjusted from the internal coupling loop (52) are shifted high in frequency relative to the fundamental free-space resonances of the radiator (51) as shown in FIG. 5A. A second plot, as depicted in FIG. 5B, shows the downward shift of the resonances (55) due to body loading, as would be experienced when a mobile device is held in a user's hand or placed against the user's head. The resonances (53;54) of the coupling loop shift lower or less and are well centered with the frequency bands of interest. Thus, the coupling loop provides a mechanism for countering detuning effects from hand and body loading.

Figure 6:
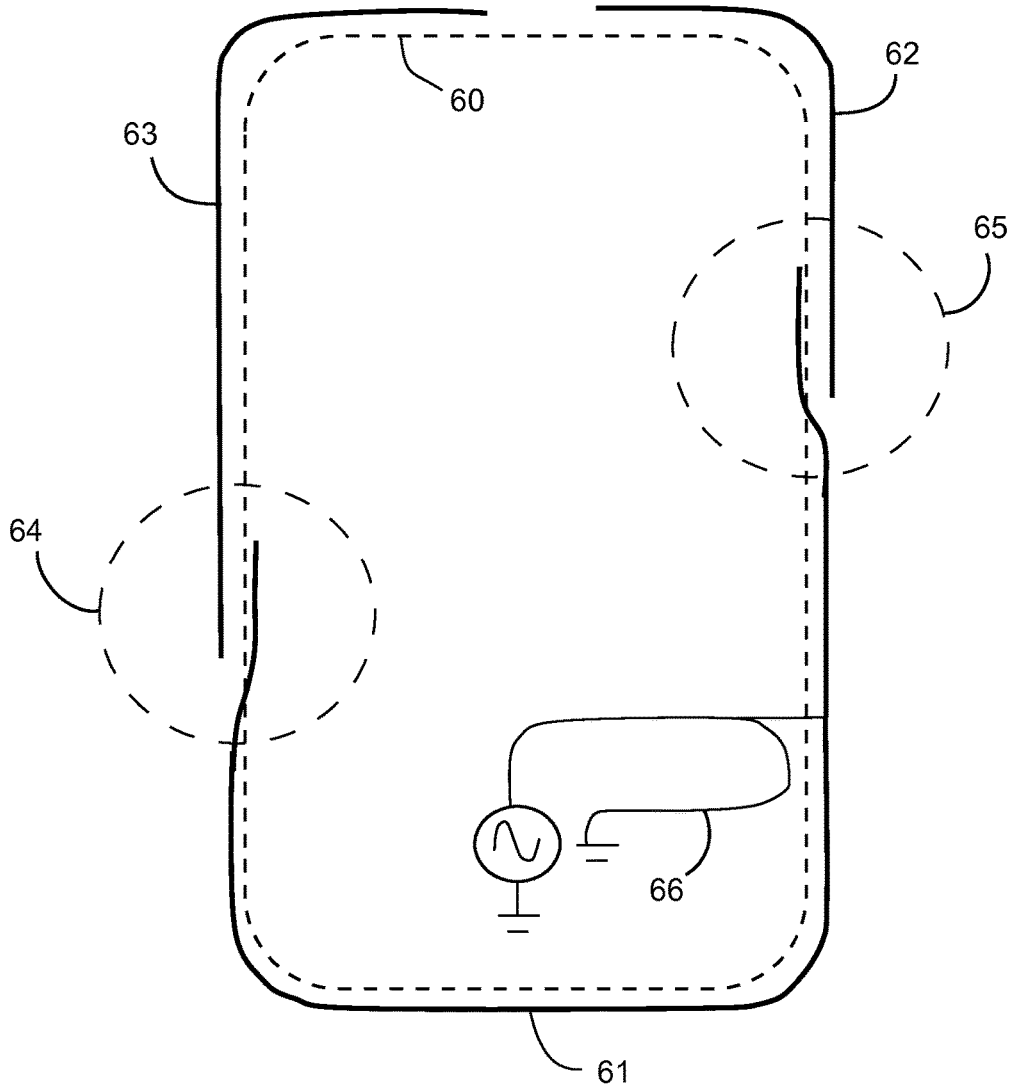
FIG. 6 illustrates an improved antenna external to a mobile device.

FIG. 6 illustrates an antenna integrated into an external portion of a mobile device. An isolated magnetic dipole (IMD) antenna is formed which contains two coupled sections 64; 65, the first coupled section 64, formed by the overlap of first conductor 61 and third conductor 63, is used to form a low frequency resonance and the second coupled section 65, formed by the overlap of conductor 61 and second conductor 62, is provided to form a high frequency resonance. A loop 66 is integrated internal to the mobile device, with the loop coupled to the IMD antenna at first conductor 61. The loop is used to feed the IMD antenna and can be adjusted to impedance match the IMD antenna to the transceiver. The internal loop is dimensioned such that the loop radiates or receives RF signals. The resonant frequency of the loop is adjusted such that the resonance is offset from the resonance of the external IMD antenna. Two coupling regions are formed in the radiator. The second conductor 62 is spaced apart from the third conductor 63.

Figure 7:
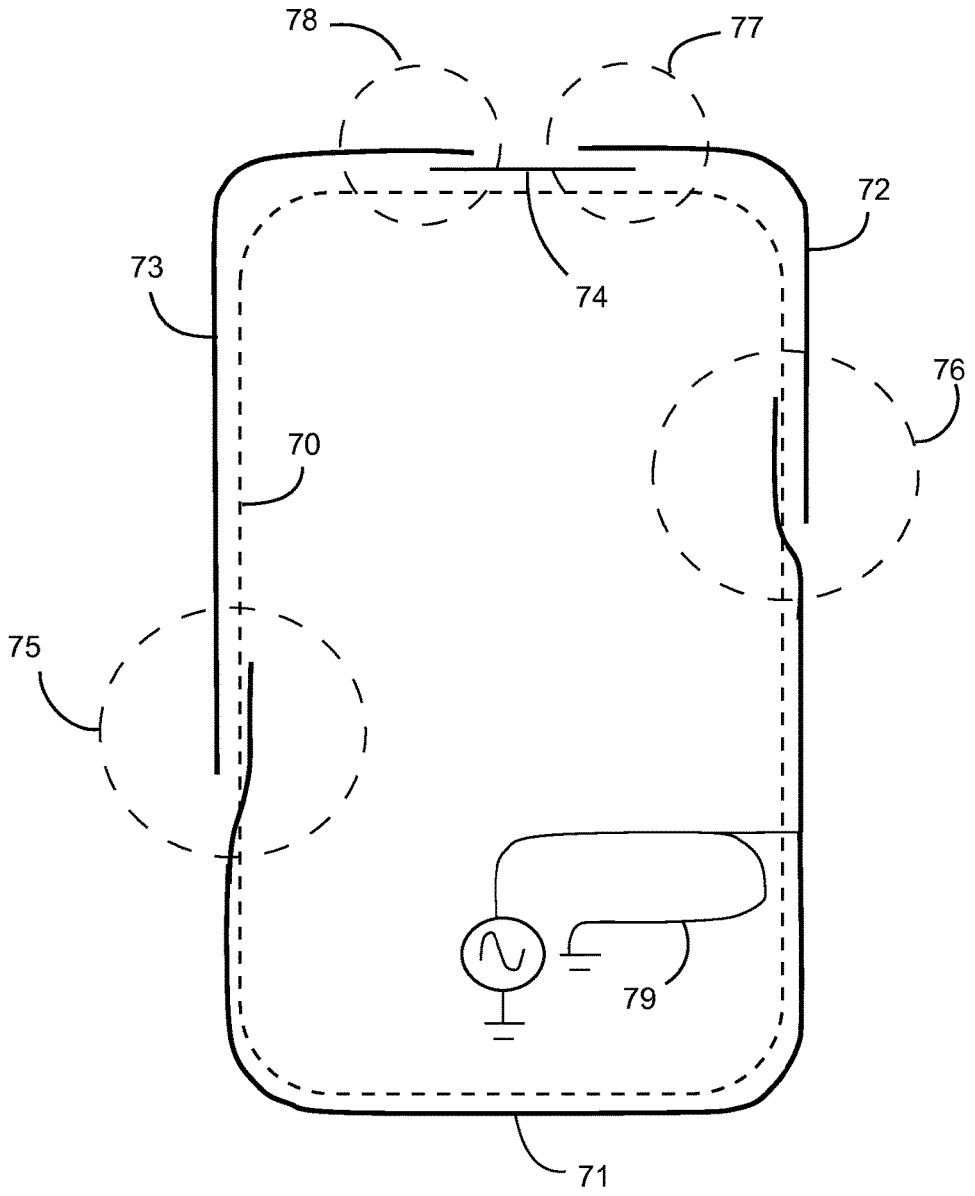
FIG. 7 illustrates an antenna assembly similar to the antenna shown in FIG. 6, with the exception that the second conductor and third conductor are coupled together by an additional conductor, a fourth conductor.

FIG. 7 illustrates an antenna assembly similar to the antenna shown in FIG. 6, with the exception that second conductor 72 and third conductor 73 are coupled together by an additional conductor, conductor four 74 forming an overlap with each of the second and third conductors, thus forming additional coupling regions and corresponding resonances. First conductor 71 is further configured to overlap with third conductor 73 to form a first coupling region 75. First conductor 71 is configured to overlap with second conductor 72 to form a second coupling region 76. The first through fourth conductors are disposed about the periphery 70 of the mobile device. A feed is coupled to first conductor 71, and a coupling loop 79 is coupled to the feed.

Figure 8A:
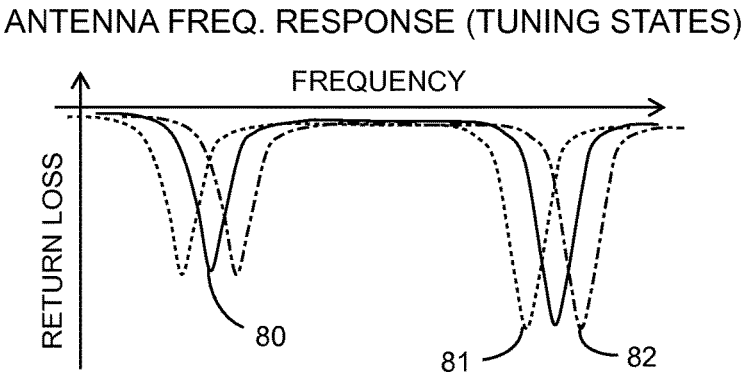
FIG. 8A illustrates the return loss behavior of a tunable antenna.
Figure 8B:
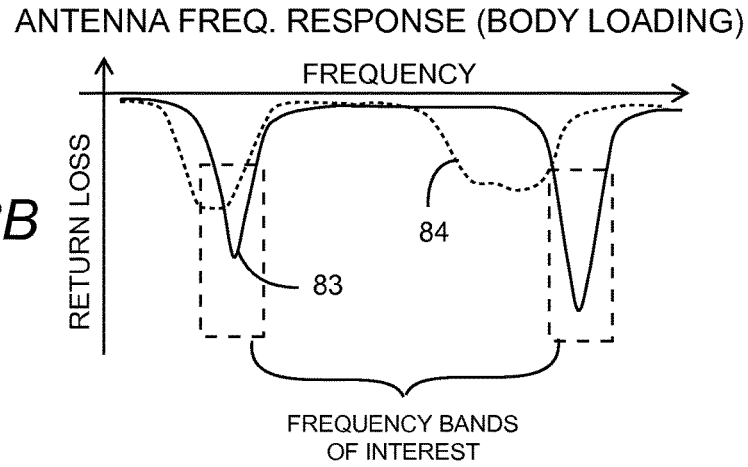
FIG. 8B illustrates the return loss behavior of the antenna when detuned from body loading.
Figure 8C:
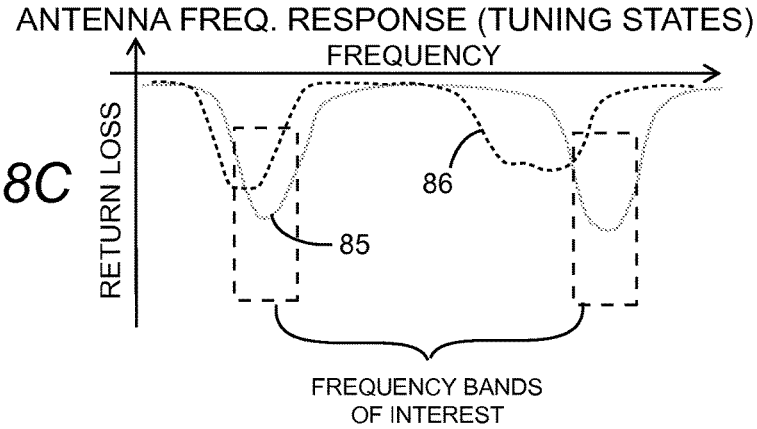
FIG. 8C illustrates the return loss behavior of the antenna detuned from body loading and re-tuned in accordance with embodiments herein.
Figure 9:
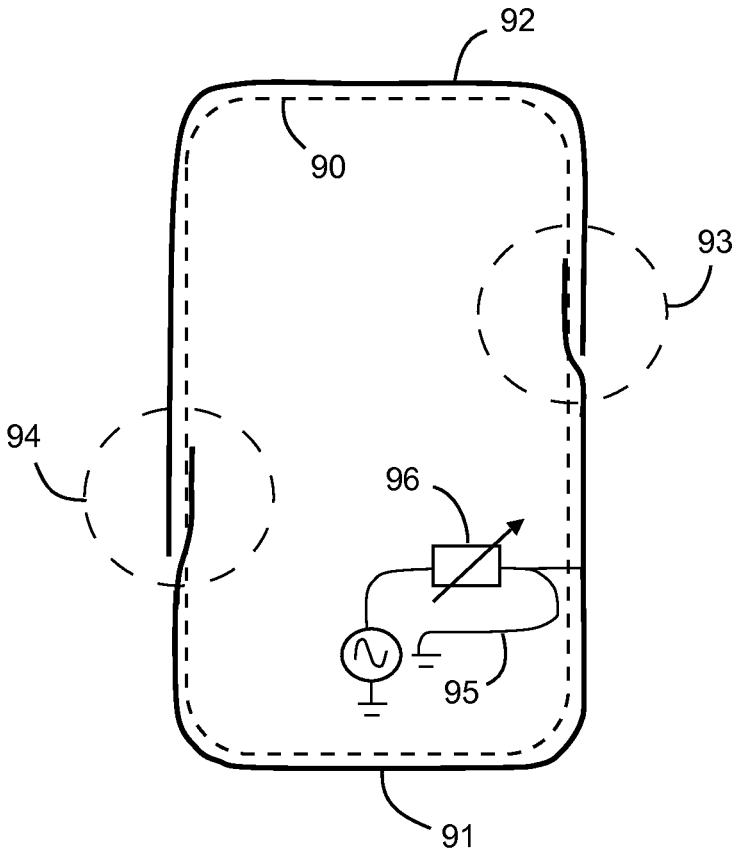
FIG. 9 illustrates an external antenna configuration coupled to an internal tuning circuit, where an active component is integrated into the tuning circuit.

FIGS. 8(A-C) illustrate the return loss behavior of a tunable antenna, such as shown in FIG. 9. The first graph, as illustrated in FIG. 8A, shows the free space response of multiple tuning states 80; 81; 82. The second graph, as illustrated in FIG. 8B, shows a free space resonance (83) and how it is degraded by body loading effects (84). The third graph, as illustrated in FIG. 8C, shows how tuning the antenna (85) can be used to compensate for body loading effects (86).

FIG. 9 illustrates an external antenna configuration coupled to an internal tuning circuit, where an active component 96 is integrated into the tuning circuit. The active component 96 is used to dynamically alter the impedance properties of the external radiator. The active component 96 can also be used to adjust the frequency response of the external radiator. The external radiator includes the first conductor 91 coupled to the second conductor 92, each of the first and second conductors disposed about the periphery 90 of the mobile device. Each end of the conductors overlaps with one another to form a first coupling region 94 and a second coupling region 93. A coupling loop 95 is coupled to the antenna feed and active component 96, each of which being further coupled to the first conductor 91.

Figure 10:
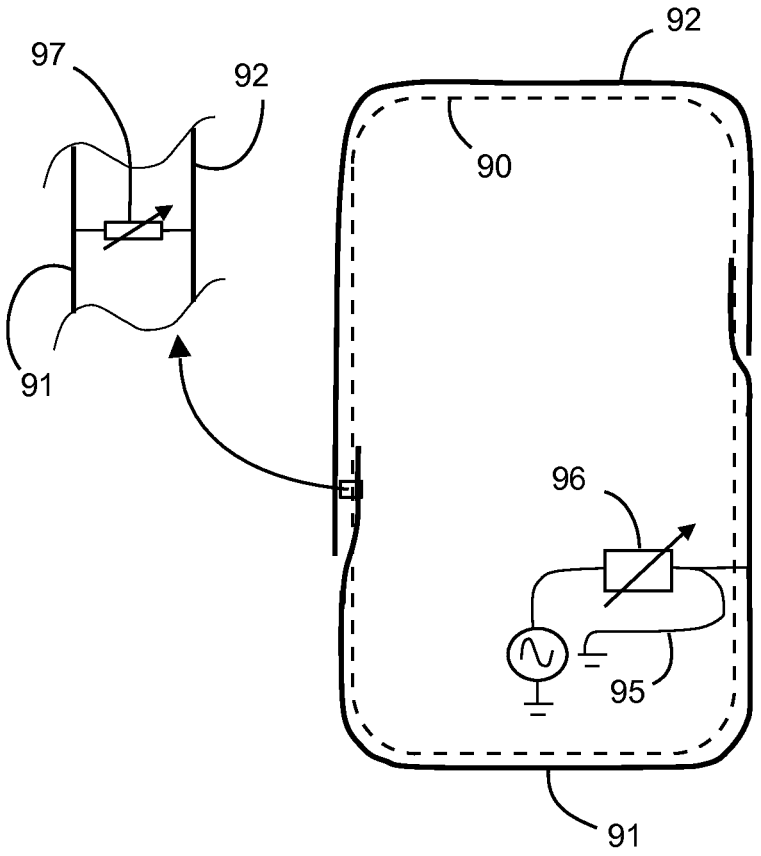
FIG. 10 illustrates an external antenna configuration coupled to an internal tuning circuit, where an active component is integrated into the coupling region of the IMD antenna formed by the first and second conductors.

FIG. 10 illustrates an external antenna configuration coupled to an internal tuning circuit, where a second active component 97 is integrated into the coupling region of the IMD antenna formed by the first and second conductors 91; 92, respectively. A first active component 96 is also integrated into the tuning circuit. The active tuning components 96; 97 are used to dynamically alter the impedance properties of the external radiator (first and second conductors 91; 92). The active tuning components can also be used to adjust the frequency response of the external radiator.

Figure 11:
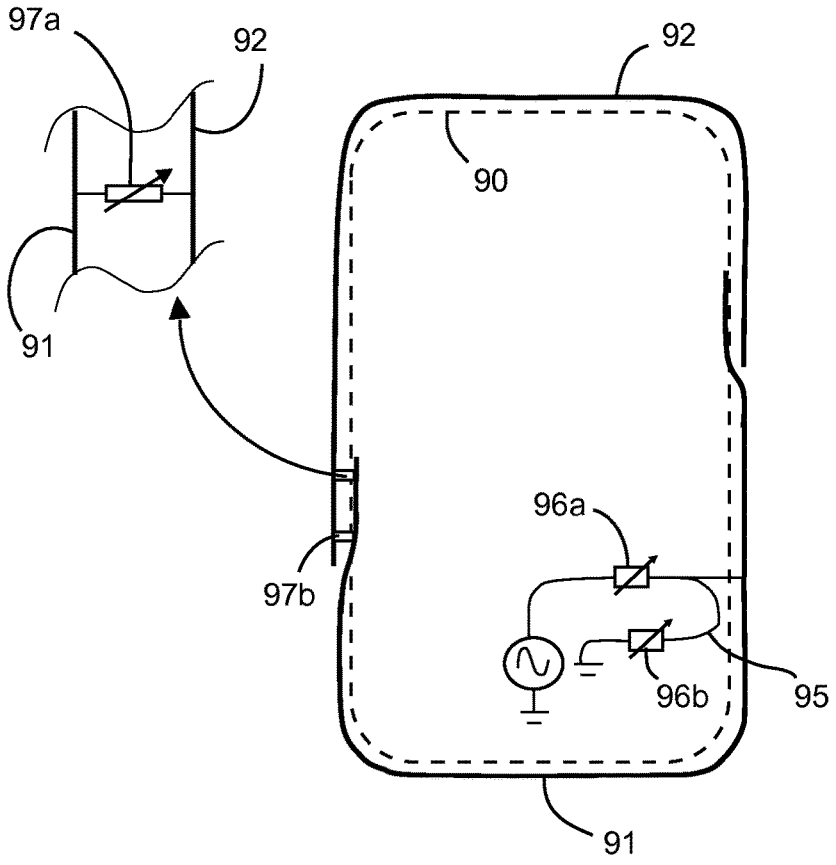
FIG. 11 illustrates an external antenna configuration coupled to an internal tuning circuit, where multiple active tuning components are integrated into the coupling regions of the IMD antenna formed by the first and second conductors.

FIG. 11 illustrates an external antenna configuration coupled to an internal tuning circuit, where multiple active tuning components 97*a*; 97*b* are integrated into the coupling regions of the IMD antenna formed by the first and second conductors 91; 92, respectively. Two active tuning components 96*a*; 96*b*, are also integrated into the tuning circuit. The active tuning components are used to dynamically alter the impedance properties of the external radiator. The active tuning components can also be used to adjust the frequency response of the external radiator.

Figure 12:
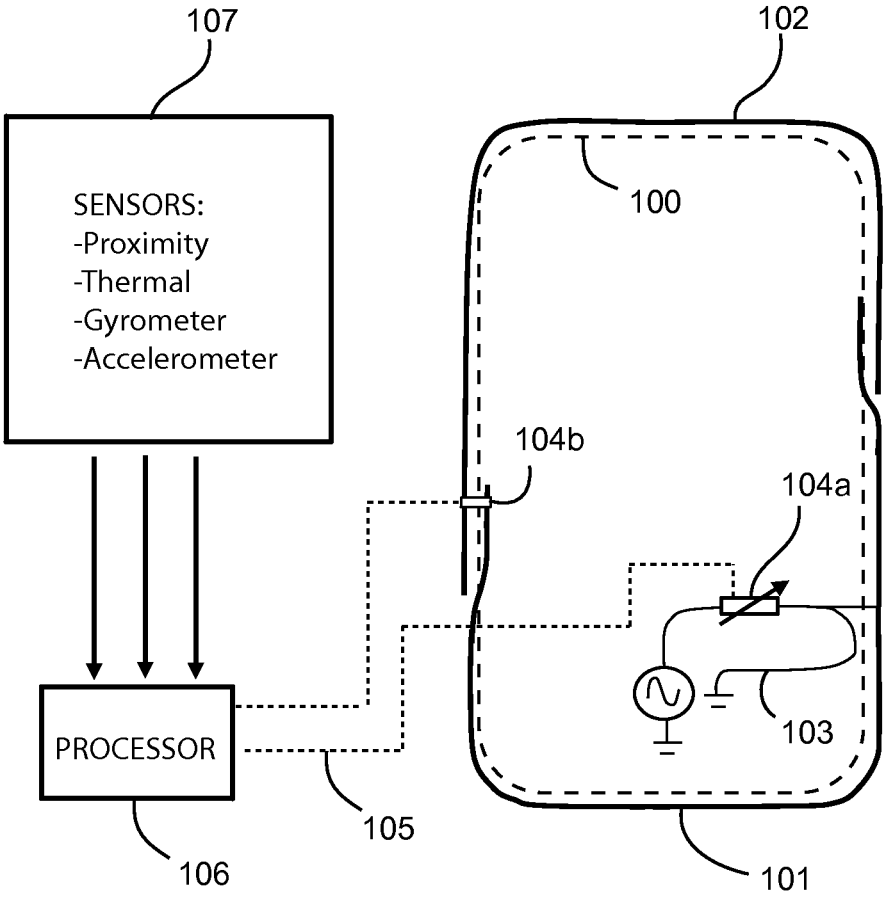
FIG. 12 illustrates an external antenna configuration coupled to an internal tuning circuit, where multiple active tuning components are integrated into the coupling regions of the IMD antenna formed by the first and second conductors, a processor controls the active tuning components by communicating control signals therewith.

FIG. 12 illustrates an external antenna configuration coupled to an internal tuning circuit, where multiple active tuning components 104*a*; 104*b* are integrated into the coupling regions of the IMD antenna formed about the device periphery 100 by the first and second conductors 101; 102, respectively. A list of sensor types is designated, where the sensors 107 provide inputs to a processor 106. The processor provides control signals 105 to the active tuning components 104*a*; 104*b* coupled to the antenna and the tuning circuit, respectively. One or more active tuning components 104*a* are also integrated into the tuning circuit. The active tuning components are used to dynamically alter the impedance properties of the external radiator. The active tuning components can also be used to adjust the frequency response of the external radiator.

Figure 13:
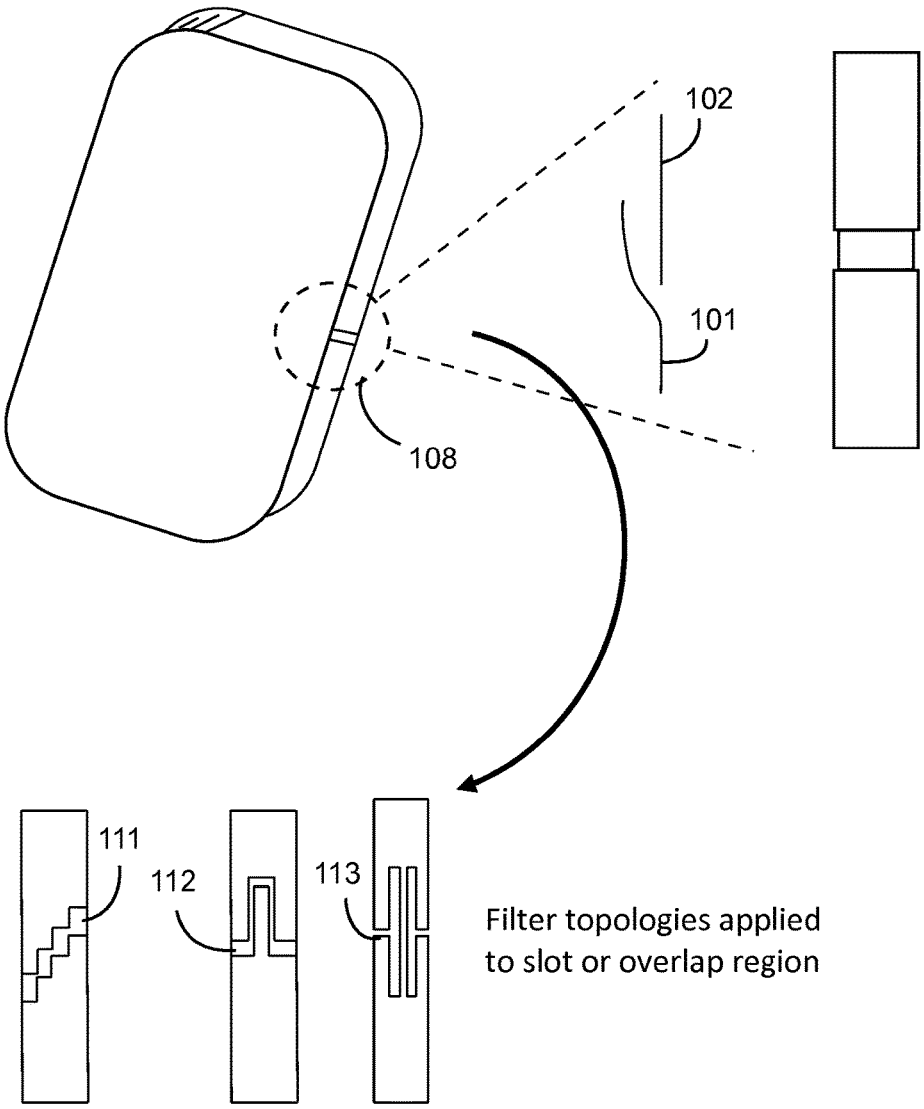
FIG. 13 illustrates the concept of applying filter techniques to the region of intersection for the two conductors used to form an external antenna.

FIG. 13 illustrates the concept of applying filter techniques to the region of intersection for the two conductors 101; 102 used to form an external antenna, herein termed the "coupling region 108". By altering the gap and configuration of the conductors in the region of overlap, filtered responses can be realized. Example filter topologies 111; 112; 113 are illustrated, these filters can be implemented at the coupling region.

Figure 14:
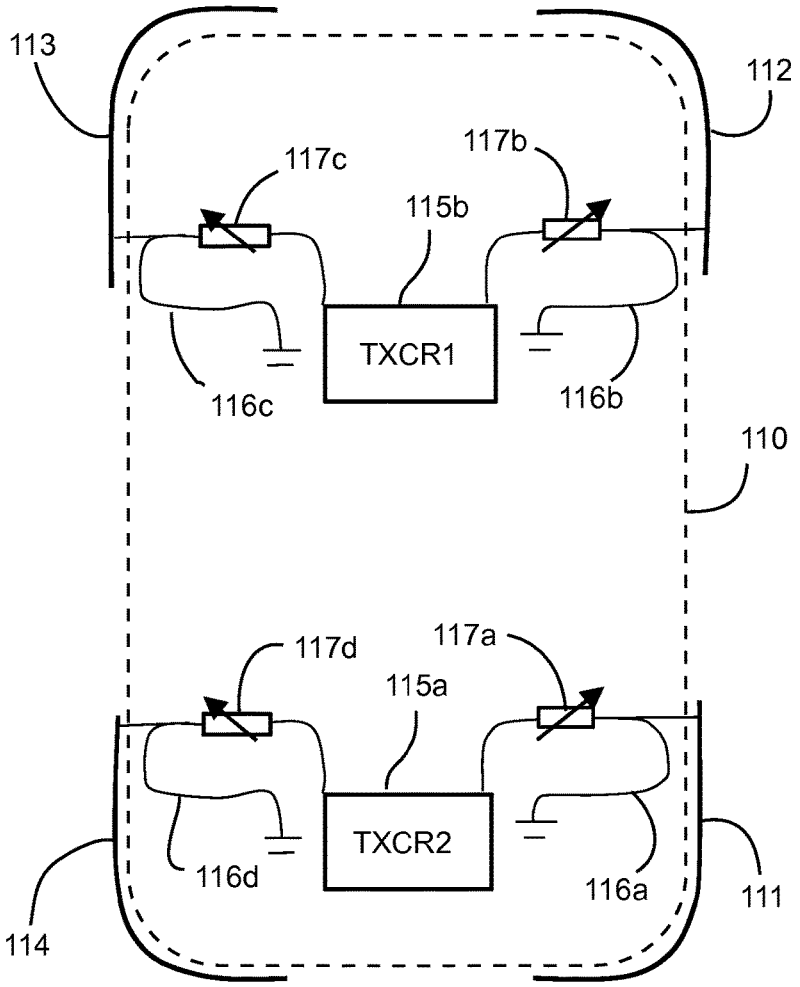
FIG. 14 shows a four-antenna configuration, where four external antennas are each connected to one of two, two-port transceivers.

FIG. 14 shows a four antenna Multi-input Multi-output (MIMO) configuration, where four external antenna conductors 111; 112; 113; 114 disposed about the periphery of the mobile device 110 are connected to two, two-port transceivers (TXCR1 and TXCR2). Tuning circuits, including coupling loops 116(*a-d*), are connected to each antenna conductor, and active tuning components 117(*a-d*) are integrated into each tuning circuit.

Figure 15:
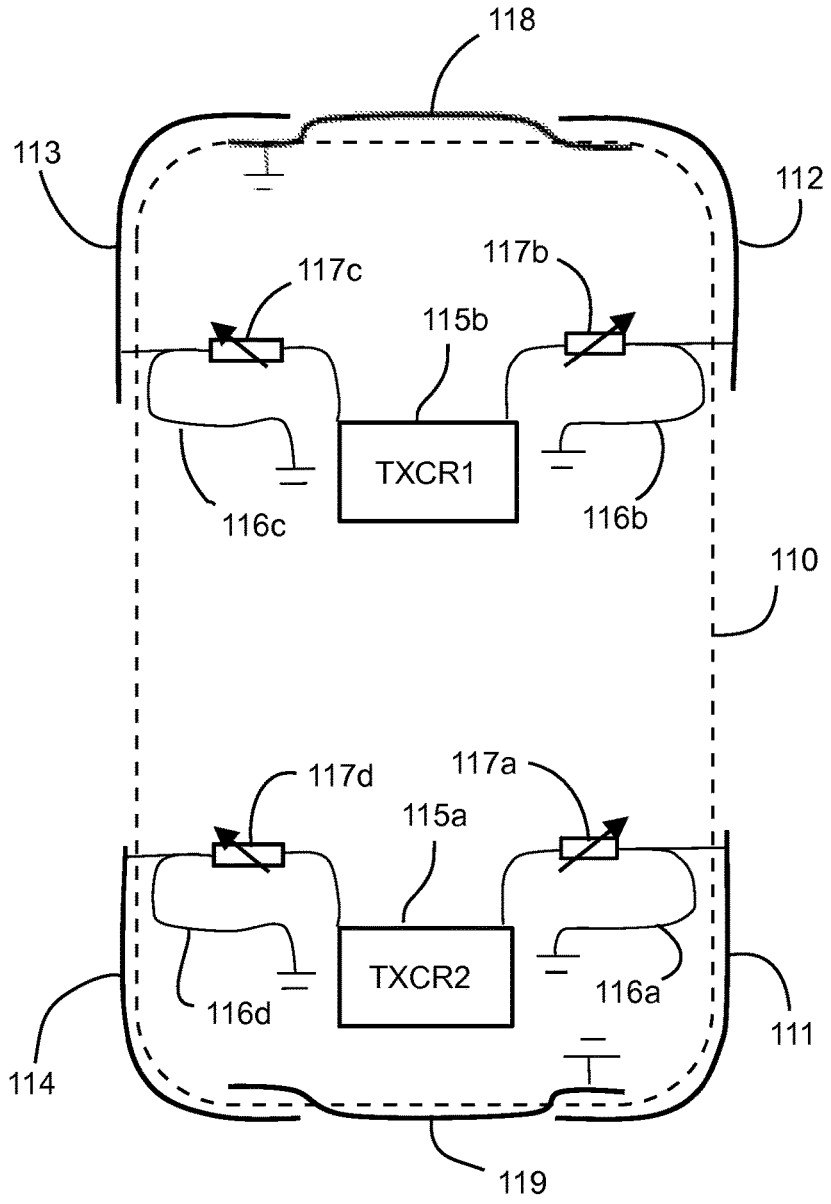
FIG. 15 illustrates four IMD antennas integrated external to the device.

FIG. 15 illustrates four IMD antennas integrated external to the device in a MIMO configuration similar to FIG. 14. Tuning circuits, including coupling loops 116(*a-d*), are connected to each antenna conductor 111-114, and active tuning components 117(*a-d*) are integrated into each tuning circuit. Here, additional conductors 118; 119 are provided to each extend between two of the antenna conductors 111-114, forming overlapping coupling regions at each terminal end as shown.

Figure 16A:
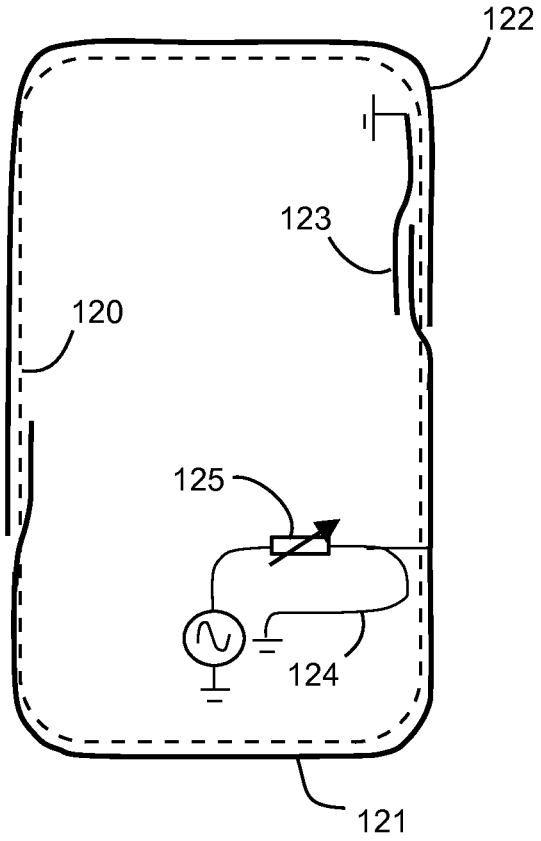
FIG. 16A illustrates an antenna with an additional conductor coupled the an external IMD antenna.
Figure 16B:
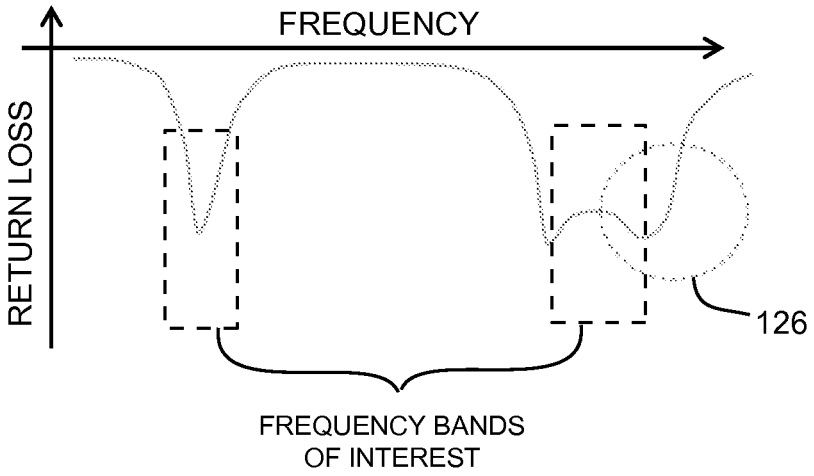
FIG. 16B illustrates the improvement in bandwidth achieved when an additional conductor is coupled to an external IMD antenna.

FIGS. 16(A-B) illustrate the improvement in bandwidth achieved when an additional conductor is coupled to an external IMD antenna. An additional resonance at the upper frequency band can be generated by coupling an additional conductor to one of the conductors in the IMD antenna. FIG. 16A shows a mobile device with a first antenna conductor 121 and a second antenna conductor 122 disposed about the periphery 120 of the device. The first and second conductors overlap at two ends, forming two coupling regions. At one of the coupling regions, a third conductor 123 is disposed and connected to ground, the third conductor 123 provides an additional resonance. FIG. 16B shows the additional resonance 126 provided by the third conductor 123.

In an embodiment of the invention, an antenna system comprises: an isolated magnetic dipole (IMD) antenna; and a tuning conductor or coupling loop. The IMD antenna is integrated into the external features of a device. The tuning conductor is integrated internal to the device. A feed port is coupled to the tuning conductor, and the tuning conductor in turn is coupled to the IMD element. The IMD element is configured to form a resonance at a desired frequency when the antenna is in free space conditions with no external loading applied. The tuning conductor is configured to form a resonance at a frequency that is shifted higher in frequency when the antenna is in free space conditions prior to applying external loading to the device. The resonant frequency of the tuning conductor is chosen such that the resonant frequency shifts into the desired frequency band when external loading is applied to the device. The combination of the external IMD antenna and the internal tuning conductor provide optimal radiating properties when the device is operated in free space condition and when an external load such as the user's hand or head is applied to the device.

In certain embodiments, one or multiple active tuning components are coupled to the tuning conductor for use in adjusting the resonant frequency of the tuning conductor.

Alternatively, the one or multiple active tuning components may be coupled to the isolated magnetic dipole antenna for use in altering the electrical length, resonant frequency, and/or impedance properties of the antenna.

The active tuning components may further comprise a switch, FET, MEMS device, or a component that exhibits active capacitive or inductive characteristics, or any combination of these components.

Although in many circumstances an IMD antenna may be a preferred radiating structure due to the superior isolation of the IMD element, the antenna element may alternatively comprise a monopole, dipole, inverted F antenna (IFA), Planar F antenna (Pifa), or loop. The invention is not restricted to the antenna types listed.

In certain embodiments, an antenna system comprises: two or more isolated magnetic dipole (IMD) antennas; and one or more tuning conductors or coupling loops. The IMD antennas are integrated into the external features of a device. The one or more tuning conductors are integrated internal to the device. One or multiple transceiver ports are coupled to the tuning conductors, and the tuning conductors are in turn coupled to the IMD antennas. The IMD antennas are configured to form a resonance at a desired frequency when the antenna is in free space conditions with no external loading applied. The one or more tuning conductors are configured to form a resonance at a frequency that is shifted higher in frequency when the antenna that the tuning conductor is coupled to is in free space conditions prior to applying external loading to the device. The resonant frequency of the tuning conductor is chosen such that the resonant frequency shifts into the desired frequency band when external loading is applied to the device. The combination of the external IMD antennas and the internal one or more tuning conductors provide optimal radiating properties when the device is operated in free space condition and when an external load such as the user's hand or head is applied to the device.

One or more active tuning components may be coupled to the one or more tuning conductors for use in adjusting the resonant frequency of each conductor.

Alternatively, one or more active tuning components are coupled to one or more isolated magnetic dipole antennas for use in altering the electrical length, resonant frequency, and/or impedance properties of the antenna or antennas.

In each of these embodiments, the active tuning components may comprise any of: a switch, FET, MEMS device, or a component that exhibits active capacitive or inductive characteristics, or any combination of these components.

We claim:

1. In a wireless communication device, an antenna system comprising:

a plurality of conductors extending along a periphery of the wireless communication device, the plurality of conductors comprising at least a first conductor and a second conductor;

a coupling loop disposed within the wireless communication device;

a feed coupled to the coupling loop; and the coupling loop and feed further coupled to the first conductor;

each of the first and second conductors having a first end and a second end opposite of the first end; with the first end of the first conductor overlapping with the first end of the second conductor to form a first coupling region; and with the second end of the first conductor overlapping with the second end of the second conductor or another of the plurality of conductors forming a second coupling region; and the first coupling region extending along a first length and being separated by a first distance between the overlapping first and second conductors, wherein the first length and first distance are configured to provide a first resonance.

2. The antenna system of claim 1, wherein the first conductor, second conductor, and coupling regions form an isolated magnetic dipole (IMD) type antenna being capacitively loaded at the coupling regions and having an inductive loop associated therewith for isolating the antenna from nearby components.

3. The antenna system of claim 2, wherein with no hand or body loading on the antenna, the coupling loop being coupled to the IMD antenna provides an antenna resonance pattern that is shifted higher in frequency with respect to a resonance of the IMD antenna itself in free-space; and, with hand or body loading on the antenna, the coupling loop being coupled to the IMD antenna provides an antenna resonance pattern that is shifted into a desired frequency band of interest.

4. The antenna system of claim 1, the plurality of conductors further including a third conductor; wherein the first conductor is configured to overlap with the third conductor to form the second coupling region, and wherein the first conductor is configured to overlap with the second conductor to form the first coupling region.

5. The antenna system of claim 4, wherein the second and third conductors do not overlap.

6. The antenna system of claim 5, further comprising a fourth conductor configured to overlap with each of the second and third conductors thereby forming a third coupling region and a fourth coupling region, respectively.

7. The antenna system of claim 1, further comprising an active tuning component coupled to the coupling loop and feed.

8. The antenna system of claim 7, said active tuning component comprising one of: a switch, field-effect transistor (FET), micro-electromechanical systems (MEMS) device, or a combination thereof.

9. The antenna system of claim 1, comprising a first active tuning component disposed at the first coupling region and a second active tuning component disposed at the second coupling region; each of the first and second active tuning components coupled to the first conductor and further coupled to the second conductor or another conductor of the plurality of conductors.

10. The antenna system of claim 1, comprising a first active tuning component and a second active tuning component each disposed at the first coupling region; each of the first and second active tuning components coupled to each of the first and second conductors.

11. The antenna system of claim 1, further comprising an active tuning component disposed at the first coupling region, said active tuning component coupled to each of the first conductor and the second conductor for providing an adjustable tuning of the first coupling region.

12. The antenna system of claim 11, the active tuning component being further coupled to a processor via control lines extending therebetween, the processor being further coupled to one or more sensors; wherein upon receiving a first signal from the one or more sensors, the processor is configured to communicate a second signal to the active tuning component for adjusting a tuning state thereof.

13. The antenna system of claim 1, wherein said one or more conductors form a monopole, dipole, inverted F antenna (IFA), Planar F antenna (Pifa), or loop.

14. The antenna system of claim 1, comprising one or more filter topologies integrated within at least one of the conductors of the first coupling region.

15. The antenna system of claim 1, further comprising a third conductor, the third conductor configured to overlap with each of the first and second conductors at the first coupling region, wherein the third conductor is further connected to ground for providing an additional resonance of the antenna system.

16. In a wireless communication device, an antenna system comprising:

a plurality of conductors extending along a periphery of the wireless communication device, the plurality of conductors comprising at least a first conductor, a second conductor, a third conductor, a fourth conductor, and a fifth conductor;

a coupling loop disposed within the wireless communication device;

a feed coupled to the coupling loop; and the coupling loop and feed further coupled to the first conductor;

the antenna system further comprising four coupling loops, the coupling loops including:

a first coupling loop, second coupling loop, third coupling loop, and a fourth coupling loop, wherein each of the first through fourth coupling loops is independently coupled to one of the first through fourth conductors;

four active tuning components, including: a first active tuning component, a second active tuning component, a third active tuning component, and a fourth active tuning component, each of the first through fourth active tuning components being coupled to one of the first through fourth coupling loops and one of the first through fourth conductors, respectively;

a first transceiver, the first transceiver comprising a first feed coupled to the first coupling loop and the first conductor and a second feed coupled to the second coupling loop and second conductor;

a second transceiver, the second transceiver comprising a third feed coupled to the third coupling loop and the third conductor and a fourth feed coupled to the fourth coupling loop and fourth conductor;

wherein the first through fourth conductors of the antenna system form a MIMO configuration; and the fifth conductor being oriented about the periphery of the device and configured to overlap with each of the second and third conductors, respectively, forming a first coupling region at an overlap of the fifth conductor and the third conductor, and a second coupling region at an overlap of the fifth conductor and the second conductor.

17. The antenna system of claim 16, wherein said fifth conductor is connected to ground.

18. The antenna system of claim 17, further comprising a sixth conductor, the sixth conductor being oriented about the periphery of the device and configured to overlap with each of the first and fourth conductors, respectively, forming a third coupling region at an overlap of the sixth conductor and the fourth conductor, and a fourth coupling region at an overlap of the sixth conductor and the first conductor.

19. The antenna system of claim 18, wherein said sixth conductor is connected to ground.

* * * * *